US011346048B2

(12) United States Patent
Eryilmaz et al.

(10) Patent No.: US 11,346,048 B2
(45) Date of Patent: May 31, 2022

(54) COMPOSITE FABRIC COMPRISING A BACTERIAL BIOPOLYMER LAYER

(71) Applicant: Sanko Tekstil Isletmeleri San. Ve Tic. A.S., Bursa (TR)

(72) Inventors: Jitka Eryilmaz, Bursa (TR); Onur Yukselen, Bursa (TR); Ozgur Cobanoglu, Bursa (TR)

(73) Assignee: Sanko Tekstil Isletmeleri San. Ve Tic. A.S., Bursa (TR)

( * ) Notice: Subject to any disclaimer, the term of this patent is extended or adjusted under 35 U.S.C. 154(b) by 53 days.

(21) Appl. No.: 15/493,713

(22) Filed: Apr. 21, 2017

(65) Prior Publication Data

US 2017/0314190 A1 Nov. 2, 2017

(30) Foreign Application Priority Data

Apr. 27, 2016 (EP) ..... 16167312
Apr. 27, 2016 (EP) ..... 16167320

(51) Int. Cl.
*D06N 3/00* (2006.01)
*D06P 1/22* (2006.01)
(Continued)

(52) U.S. Cl.
CPC ..... *D06P 1/228* (2013.01); *D03D 13/004* (2013.01); *D03D 13/008* (2013.01); *D03D 15/56* (2021.01);
(Continued)

(58) Field of Classification Search
CPC .... D06P 1/228; D06P 1/50; D06P 1/48; D06P 1/46; D03D 13/004; D03D 13/008;
(Continued)

(56) References Cited

U.S. PATENT DOCUMENTS 8,596,305 B2 12/2013 Govindaswamy
2004/0048451 A1 3/2004 Offord et al.
(Continued)

FOREIGN PATENT DOCUMENTS

CN 102834557 12/2012
DE 19913609 11/1999
(Continued)

OTHER PUBLICATIONS

Derwent abstract jp-10077302 (Year: 1998).*
(Continued)

*Primary Examiner* — Vincent Tatesure
(74) *Attorney, Agent, or Firm* — Silvia Salvadori

(57) ABSTRACT

Provided is a composite fabric having a base fabric and at least one bacterial biopolymer layer. The base fabric is a woven fabric, and includes warp yarns and weft yarns. At least a first plurality of warp yarns and a first plurality of weft yarns form a base layer of the base fabric. A second plurality of warp yarns and/or a second plurality of weft yarns forms an additional layer of loop portions on at least one of the sides of the base fabric. The bacterial biopolymer layer is provided at least on part of the additional layer. Further provided is a process for the production of the composite fabric and a clothing article formed of the composite fabric.

13 Claims, 7 Drawing Sheets

(51) Int. Cl.

| | |
|---|---|
| ***D03D 27/00*** | (2006.01) |
| ***D06P 5/12*** | (2006.01) |
| ***D06P 1/46*** | (2006.01) |
| ***D06P 1/48*** | (2006.01) |
| ***D06P 1/50*** | (2006.01) |
| ***D03D 15/56*** | (2021.01) |
| ***D06M 15/05*** | (2006.01) |
| ***D06M 15/11*** | (2006.01) |
| ***D06M 15/15*** | (2006.01) |
| ***D06M 16/00*** | (2006.01) |
| ***D06M 23/06*** | (2006.01) |
| ***D06N 3/12*** | (2006.01) |
| ***D03D 13/00*** | (2006.01) |
| ***D06N 3/02*** | (2006.01) |
| *D06M 101/06* | (2006.01) |
| *D06P 3/60* | (2006.01) |

(52) U.S. Cl.
CPC ..... *D03D 27/00* (2013.01); *D06M 15/05* (2013.01); *D06M 15/11* (2013.01); *D06M 15/15* (2013.01); *D06M 16/003* (2013.01); *D06M 23/06* (2013.01); *D06N 3/0006* (2013.01); *D06N 3/009* (2013.01); *D06N 3/0015* (2013.01); *D06N 3/0088* (2013.01); *D06N 3/02* (2013.01); *D06N 3/12* (2013.01); *D06P 1/46* (2013.01); *D06P 1/48* (2013.01); *D06P 1/50* (2013.01); *D06P 5/12* (2013.01); *D06M 2101/06* (2013.01); *D06N 2201/042* (2013.01); *D06N 2203/026* (2013.01); *D06N 2203/028* (2013.01); *D06N 2209/1635* (2013.01); *D06N 2211/10* (2013.01); *D06P 3/6025* (2013.01); *D10B 2201/02* (2013.01); *D10B 2501/00* (2013.01)

(58) Field of Classification Search
CPC ..... D03D 15/08; D03D 27/00; D06M 15/05; D06M 15/11; D06M 15/15; D06M 16/003; D06M 23/06; D06N 3/0006; D06N 3/0015; D06N 3/0088; D06N 3/009; D06N 3/02; D06N 3/13
USPC ..... 442/59
See application file for complete search history.

(56) References Cited

U.S. PATENT DOCUMENTS

| | | | | |
|---|---|---|---|---|
| 2012/0082712 | A1 | 4/2012 | Stopek et al. | |
| 2013/0000057 | A1 | 1/2013 | Schoots | |
| 2013/0048140 | A1* | 2/2013 | Yenici | D03D 15/04 139/422 |
| 2013/0225476 | A1* | 8/2013 | Scheibel | C07K 14/00 514/1.1 |

FOREIGN PATENT DOCUMENTS

| | | | |
|---|---|---|---|
| EP | 2539493 | | 5/2015 |
| JP | H03269185 | | 11/1991 |
| JP | H09 279 483 | | 10/1997 |
| JP | H09279483 | | 10/1997 |
| JP | 10077302 | A * | 3/1998 |
| WO | 2008020187 | | 2/2008 |
| WO | 20080020187 | | 2/2008 |
| WO | 20100525585 | | 5/2010 |
| WO | 2011104022 | | 9/2011 |

OTHER PUBLICATIONS

International search report dated Jul. 25, 2017 for PCT/EP2017/059477.
European Search Report dated Oct. 25, 2016 for Priority European patent application No. 16167312.4.
European Search Report dated Oct. 26, 2016 for Priority European patent application No. 16167320.7.
International search report dated Jul. 25, 2017 for PCT/EP2017/059471.
XP002762770 Database WPI Week 199802 Thomson Scientific, London, GB; AN 1998-015342.
International Preliminary Report on Patentability dated Nov. 8, 2018 for corresponding International patent application No. PCT/EP2017/059477.
Office Action dated Sep. 1, 2021 by the Brazilian Patent Office and relevant EN letter of the BR Local Agent for corresponding BR application No. BR102017008596-1.
Office Action dated Mar. 30, 2020 by the Chinese Patent Office and relevant EN letter of the CN Local Agent for corresponding CN application No. 201710283753.1.
Notice of Opposition and relevant arguments filed at the EPO on May 5, 2021 for corresponding EP application No. 16167320.7.
Wikipedia, "Wikipedia article relating to Carbohydrate captured by the Way Back Machine on Nov. 7, 2015", [cited Nov. 7, 2015] Available from: [http://web.archive.org/web/20151107014733/https://en.wikipedia.org/wiki/Carbohydrate].
Wikipedia, "Wikipedia article relating to Chitin captured by the Way Back Machine", [cited Nov. 6, 2015] Available from: [http://web.archive.org/web/20151106043534/https://en.Wikipedia.org/wiki/Chitin].
Wikipedia, "Wikipedia article relating to Chitosan captured by the Way Back Machine", [cited Sep. 27, 2015] Available from: [https://web.archive.org/web/2015092705270 7 /https://de.Wikipedia.org/wiki/Chitosan].
Wikipedia, "Wikipedia article relating to Batik captured by the Way Back Machine", [cited Sep. 21, 2015] Available from: [http://web.archive.org/web/20150921030014/https://de.wikipedia.org/wiki/Batik].
Wikipedia, "Wikipedia article relating to Impregnation captured by the Way Back Machine", [cited 23.09.2015] Available from: [http://web.archive.org/web/20150923235259/https://de.wikipedia.org/wiki/lmpr %C3% A4gnierung].
Collins Dictionary, "Collins dictionary: Definition of the term "loop"", [cited May 4, 2021] Available from: [https://www.collinsdictionary.com/de/worterbuch/englisch/loop] original file name: D11_Loop Definition—Collins dictionary. PDF.
Proprietor's response to the notice of Opposition against EP3239373 filed at the EPO on Sep. 30, 2021.
Summons to attend Oral proceedings issued by the EPO on Feb. 8, 2022 for corresponding EP3239373.

* cited by examiner

1 = First weft yarns
2 = Second weft yarns

COMPOSITE FABRIC COMPRISING A BACTERIAL BIOPOLYMER LAYER

RELATED APPLICATIONS

This application claims priority to European Application EP16167320.7 filed Apr. 27, 2016, and titled "A Process of Preparing a Dyed Fabric Including a Bacterial Biopolymer and Having Unique Appearance," and also claims priority to European Application EP16167312.4 filed Apr. 27, 2016, and titled "Composite Fabric Comprising a Bacterial Biopolymer Layer", the contents of each of which are hereby incorporated by reference, as if set forth in their entireties.

TECHNICAL FIELD

The present invention relates to composite fabrics which are suitable for the production of clothing articles. The present invention further relates to a process for the production of a composite fabric and to clothing articles comprising it.

In particular, the fabric of the present invention is a composite fabric, comprising a woven fabric and at least one bacterial biopolymer layer, i.e. a layer of a biopolymer obtained from microorganisms.

BACKGROUND

Composite fabrics are fabrics that comprise two or more constituent materials with different physical or chemical properties that, when combined, produce a material, i.e. a fabric, with characteristics different from the individual components. The individual components substantially remain separate and distinct within the finished structure.

For example, one component of a composite fabric can be a strong fiber such as fiberglass, Kevlar®, or carbon fiber that gives the material its tensile strength, while another component can be a resin, such as polyester or epoxy, that binds the fibers together.

Composite fabrics wherein a base fabric is coupled with a biopolymer, are also known.

The bacterial cellulose is one of the most known and studied bacterial biopolymers.

The bacterial cellulose is an organic compound with the formula $(C_6H_{10}O_5)_n$, the same of plant cellulose, that is produced from certain types of bacteria as extracellular polymer.

Although the bacterial cellulose has the same molecular formula of the plant cellulose, it differs from the latter one in macromolecular properties. In fact, bacterial cellulose is generally more chemically pure with respect to plant cellulose (i.e., it contains no hemicellulose or lignin), and it has a higher water holding capacity, a greater tensile strength, a higher degree of polymerization and a higher crystallinity.

Due to these peculiar properties, the bacterial cellulose has been applied in several technical fields, such as food industry, medical field (e.g. as wound dressing and in blood vessel regeneration) and in paper restoration.

The application of bacterial cellulose in the field of textiles is also known.

For example, it is known that is possible to produce garments entirely made of bacterial cellulose. In fact, a layer of bacterial cellulose can be harvested from the culture medium of a culture of bacterial cellulose-producing bacteria, and subsequently shaped and dried, to obtain a garment, e.g. a dress.

Additionally, as above mentioned, composite fabrics wherein a biopolymer, e.g. the bacterial cellulose, is coupled with a base fabric are also known.

For example, WO2010/052585 discloses a composite implant comprising a prosthetic fabric coupled with a non-porous film of bacterial cellulose. The prosthetic fabric of WO2010/052585 has a three dimensional structure having two faces: one face is porous and open to post-surgical cell colonization, while the second face is bound to a non-porous film of bacterial cellulose. WO2010/052585 discloses that the bacterial cellulose film and prosthetic fabric can be assembled in a variety of ways; e.g., a fabric can be placed on top of the microbial cellulose wet pellicles formed at the surface of a fermentation broth, so that bacteria are maintained in the culture medium and the microbial cellulose pellicle continues to grow into the structure of the fabric.

As above mentioned, WO2010/052585 discloses a composite implant, which is not suitable for the production of garments and, in particular, is not suitable to be dyed.

WO2008/020187 discloses a material comprising cellulose associated with a support selected from a polymer and/or a fiber, wherein the cellulose is produced by microorganisms, preferably bacteria. The composite material of WO2008/020187 is produced through a process comprising contacting a culture medium comprising a support selected from a polymer or a fiber with a cellulose-producing microorganism.

US 2012/082712 A1 discloses an implantable medical device which includes at least one polymeric film layer made from a mixture of glycerol and at least one biopolymer. US 2012/082712 A1 describes that the polymeric film layers may be combined with another implantable substrate, e.g., a mesh provided with spiked naps that give the mesh the ability to attach to tissue when implanted.

JPH09279483 discloses a fujiette fabric treated with a culture medium for a cellulose-producing microorganism, and the cellulose-producing microorganism is cultured on the surface of the rayon filaments constituting the fabric.

The known composite fabrics comprising a biopolymer layer, in particular those composite fabrics for the production of clothing articles have, however, several drawbacks.

For example, the layer of biopolymer, e.g. bacterial cellulose, is easily subjected to detachment from the fabric. To overcome this problem, anchoring polymers and/or chemical cross-linkers have to be used to keep the biopolymer, e.g. the bacterial cellulose, attached to the fabric. However, the use of anchoring polymers and/or chemical cross-linkers increases the costs of manufacturing, and causes the production of polluting waste products.

A problem of known composite fabrics is that they are difficult to dye and require a great amount of dye to achieve the coloration desired, increasing the costs for their production and making them not suitable for the production of garments.

Moreover, since known composite fabrics are difficult to dye, fashionable effects, required in the production of clothing articles and garments, cannot be fully achieved.

SUMMARY

It is an aim of the present invention to solve the above mentioned problems and to provide a composite fabric comprising a bacterial biopolymer layer, which can be easily and effectively dyed, so that they are suitable to be used for the production of clothing articles.

Another aim of the present invention, is to provide a composite fabric which can be manufactured in an easy, not expensive and environmentally friendly way.

Another aim of the present invention, is to provide a composite fabric which is resistant and that avoids detachment of the bacterial biopolymer layer from the base fabric.

These and other aims are achieved by the claimed composite fabric that can be produced by the claimed process which is suitable for the manufacture of the claimed clothing article.

The present invention relates to a composite fabric, comprising a base fabric and at least one bacterial biopolymer layer, wherein the base fabric is a woven fabric comprising warp yarns and weft yarns woven together, and having a front side and a back side, wherein a first plurality of warp yarns and at least one plurality of first weft yarns form a base layer of the base fabric, and wherein at least one second plurality of warp yarns and/or at least one plurality of second weft yarns forms an additional layer of the base fabric in the form of loop portions, on at least one of the sides of the base fabric, wherein the at least one bacterial biopolymer layer is provided at least on part of the additional layer. In the final product, the bacterial biopolymer is provided at least on a part of the side of the fabric, where the loops are present; the loops act as "securing means" to maintain the biopolymer layer attached to the side of the base fabric.

In fact, it has been surprisingly observed that a composite fabric, comprising a base fabric which has an additional layer in the form of loop portions, and at least one bacterial biopolymer layer, that is provided on, namely "coupled" to, the loop portions, can be easily dyed and is thus suitable for the production of clothing articles (i.e., garments).

In particular, it has been observed that a composite fabric according to the invention presents a high dye-uptake capability, which allows to obtain a dyed composite fabric in an easier, faster and cheaper way, with respect to the known composite fabrics, and with low consumption of dyeing products and a low production of waste products. At the same time, the loops provide a reliable way of securing the biopolymer to the fabric, so that the composite fabric can undergo dyeing and finishing processes without the biopolymer being detached from the base fabric.

Without being bound to a specific scientific explanation, it has been hypothesized that anchoring polymers and/or chemical cross-linkers, that are commonly used to keep biopolymer layers (such as layers comprising bacterial cellulose) attached to fabrics, react with the majority of the —OH groups (i.e. hydroxyl groups) of the bacterial biopolymer and the fabric, thus "occupying" said —OH groups, and therefore preventing the reaction of such —OH groups with other products, such as, for example, the dye.

It has been now surprisingly observed that the loop portions, which form the additional layer of the base fabric of the invention, allow to avoid the use of anchoring polymers and/or chemical cross-linkers to couple and keep the bacterial biopolymer layer attached to the base fabric, thus providing a composite fabric having a high dye uptake. Therefore, it is possible to obtain an effective dyeing of the composite fabric, which makes the composite fabric suitable for the use in the production of garments, in particular for the production of garments having fashionable visual effects and appearance. Without being bound to a specific scientific explanation, it has been hypothesized that loop portions, which form the additional layer of the base fabric of the invention, act as physical binders between the bacterial biopolymer layer and base fabric, such that there is no need for chemical cross-linkers, leaving the chemical —OH groups (i.e. hydroxyl groups) of the bacterial biopolymer and of the fabric available to react with the dye.

In other words, since chemical cross-linking agents have not to be used, —OH groups (i.e. hydroxyl groups) of both the bacterial biopolymer layer and base fabric are not "occupied" by the cross-linking agents, and are therefore "free" to react with the dye (for example, indigo dye) during the dyeing process of the composite fabric.

This is particularly true when, according to an aspect of the invention, the bacterial biopolymer layer is grown (i.e. produced) directly on the fabric, i.e. on the base fabric. In fact, advantageously, a bacterial biopolymer layer according to the invention can be produced directly on a fabric, specifically, on a base fabric according to the invention, thus providing the composite fabric of the invention.

For example, a composite fabric according to the invention, can be advantageously produced by contacting the side of the base fabric where at least a plurality of warp yarns and/or at least a plurality of weft yarns form an additional layer of loop portions (e.g. the front side, the back side, or both sides of the base fabric), with a culture of bacterial biopolymer-producing microorganisms, and by culturing the bacterial biopolymer-producing microorganisms. The loop portions allow the bacterial biopolymer-producing microorganisms to pass through the additional layer (which is formed by the loop portions), reaching and contacting the base layer of the base fabric. In the following description, reference is made to weft yarns having loops. However, loops may be provided on warp yarns in alternative to loops on weft yarns; or loops may be provided both warpwise and weftwise.

In some embodiments, the bacterial biopolymer-producing microorganisms (namely the culture of microorganisms producing a bacterial biopolymer) do not penetrate deeply into the base layer of the base fabric, but they substantially settle on the surface of the base layer, and then grow on the base layer of the base fabric, thus producing a layer of bacterial biopolymer which grows and extends from the surface of the base layer through the additional layer of the base fabric. For example, according to an embodiment of the invention, the bacterial biopolymer layer extends from the surface of the base layer to the top of the additional layer, and over the top of the additional layer. More in detail, once the base fabric is contacted with a culture of bacterial biopolymer-producing microorganisms, the bacterial biopolymer-producing microorganisms are cultured, allowing them to produce a bacterial biopolymer on the base fabric to form a bacterial biopolymer layer, directly on the base fabric, and extending through the additional layer of the base fabric, thus providing a composite fabric according to the invention.

According to embodiments of the invention, the bacterial biopolymer layer may have a thickness that is smaller, equal or greater than the thickness of the additional layer.

As used herein, the term "thickness", refers to the distance between the top and bottom or front and back surfaces of something; e.g., the distance between the top and bottom surfaces of the bacterial biopolymer layer. The bottom surface of the bacterial biopolymer layer is the surface of the bacterial biopolymer layer which contacts the base layer of the base fabric. The top surface of the bacterial biopolymer layer is the surface of the bacterial biopolymer layer, opposite to the bottom surface, which does not contact the base fabric.

In various embodiments, the bacterial biopolymer layer may be produced directly on the base fabric, in order to provide a composite fabric having the loop portions (which form the additional layer of the base fabric) extending into the bacterial polymer layer, i.e., in other words, having the loop portions "immersed" or "interwoven" into the layer of bacterial biopolymer. The bacterial polymer layer is thus "anchored" (i.e. "attached" or "secured") to the base fabric through the loop portions, the loop portions acting as "securing means".

Advantageously, the loop portions have a dual function: i) when the base fabric is contacted with a culture of bacterial biopolymer-producing microorganisms, the loop portions (which forms the additional layer of the base fabric) allow the microorganisms to reach the base layer (namely the surface of the base layer) of the base fabric, where they substantially settle, so that the bacterial biopolymer layer (for example, a bacterial cellulose layer) can be produced, i.e. "grown", between and on the loops (i.e. the loop portions), thus extending through the additional layer of the base fabric; ii) the loop portions act as physical binders between the bacterial biopolymer layer and the base fabric; therefore the bacterial biopolymer layer is provided (namely "coupled", "attached" or "secured") to the base fabric, without using chemical binders and/or cross-linkers. Therefore, as above mentioned, it has been hypothesized that, since chemical binders and/or cross-linkers are not used to couple the bacterial biopolymer layer to the base fabric, the chemical —OH groups of the bacterial biopolymer layer, and also the chemical —OH groups of the base fabric as well, are "free" and "available" to react with the dye.

Additionally, when the base fabric is contacted with a culture of bacterial biopolymer-producing microorganisms, the loop portions act as physical binders, allowing the "entanglement" of the bacterial biopolymer with the additional layer of the base fabric, and keeping the bacterial biopolymer layer strongly attached to the fabric so that, advantageously, further treatments and processes for the finishing of the fabric (namely, the composite fabric) do not substantially remove the biopolymer layer from the base fabric.

In an exemplary embodiment, the porosity of the base layer of the base fabric is selected in order to avoid the penetration of the bacterial biopolymer-producing microorganisms into the structure of the base layer of the base fabric. In other words, the porosity of the base layer of the base fabric may be selected according to the size of the bacterial biopolymer-producing microorganisms which have to be used.

For example, when the porosity of the base layer of the base fabric is comprised between 0.5 μm and 1 μm, the bacterial biopolymer-producing microorganisms do not substantially penetrate into the body of the base layer, but substantially remain and settle on its "surface".

According to an aspect of the invention, the base layer of the woven fabric, i.e. the base fabric, is formed by a first plurality of warp yarns and at least one plurality of first weft yarns and it is the structure which substantially determines the mechanical characteristics of the base fabric.

According to an aspect of the invention, the additional layer of the base fabric is formed by the plurality of loop portions provided on at least one of the sides of the base fabric, and at least one bacterial biopolymer layer is provided at least on part of the additional layer of loop portions.

According to an aspect of the invention, the additional layer of loop portions act as "securing means", to maintain the biopolymer layer attached to the base layer of the fabric.

As used herein, the terms "bacterial biopolymer layer" and "bacterial polymer layer" refer to a layer comprising at least one bacterial biopolymer.

As used herein, the terms "bacterial biopolymer" and "bacterial polymer" refer to all the polymers the can be produced by a microorganism, where the term "microorganism" encompasses not genetically modified (i.e. wild type) microorganisms and genetically modified microorganism. For example, a microorganism can be genetically modified in order to produce a bacterial biopolymer which is not produced by the same microorganism when it is not genetically modified (i.e., when it is a wild type microorganism).

As used herein, the term "microorganism" refers to small unicellular or multicellular living organisms that are too small to be seen with naked eye but are visible under a microscope, and encompasses bacteria, yeast, fungi, viruses and algae. As above mentioned, the term "microorganism" encompasses not genetically modified (i.e. wild type) microorganisms and genetically modified microorganism as well.

In the present description reference is made to "bacterial biopolymer" for sake of simplicity, without however limiting the scope of the invention to polymers produced by "bacteria" only, but encompassing all the polymers the can be produced by a "microorganism" as above defined.

As used herein, the wording "coupled" and "to couple" are used to define the condition of the composite fabric after growth of the bacterial biopolymer layer on at least the side of the fabric where the loops are provided. In this condition, at least part of the loops are contacted by the biopolymer layer, that also extends on at least part of the base fabric; the bacterial biopolymer envelops at least part of the loops, and the loops act as a mechanical binding means for securing the bacterial biopolymer to the fabric.

According to various embodiments, the warp yarns and/or the weft yarns are hydrophilic yarns.

Advantageously, when the warp yarns and/or the weft yarns are hydrophilic yarns, the culture medium of the microorganisms can be absorbed by the base fabric, thus providing nutrients to the microorganisms and ingredients for the synthesis of the bacterial biopolymer layer, directly on the base fabric.

According to embodiments of the invention, hydrophilic yarns are natural yarns, i.e. yarns that are made of natural fibers.

In various embodiments, natural yarns comprise natural fibers selected from cotton, wool, flax, kenaf, ramie, hemp, linen and mixtures thereof.

According to embodiments of the invention, hydrophilic yarns are synthetic yarns, i.e. yarns that are made of synthetic fibers.

In various embodiments, synthetic yarns comprise synthetic fibers selected from polyester, rayon, nylon, lycra and mixtures thereof.

According to embodiments, synthetic yarns comprise fibers of elastane.

According to embodiments, the yarns comprise regenerated fibers; for example regenerated fibers can be selected from lyocell, modal, viscose, bamboo, and mixture thereof.

According to various embodiments, synthetic yarns and/or synthetic fibers are treated (i.e. finished) in order to provide synthetic yarns and/or synthetic fiber having hydrophilic properties.

For example, synthetic yarns and/or synthetic fibers, that are not hydrophilic per se, can be treated with a hydrophilizing agent in order to gain hydrophilic features.

According to embodiments, hydrophilic yarns are mixed yarns, i.e. yarns that comprise both natural and synthetic fibers. In this case, for example, a hydrophilic mixed yarn can be obtained by mixing hydrophilic natural fibers and hydrophobic synthetic fibers.

According to various embodiments, the bacterial biopolymer layer comprises a sugar-based biopolymer or an amino acid-based biopolymer or mixtures thereof.

As used in the present description, the term "sugar-based biopolymer" encompasses linear and branched polysaccharides, variants and derivatives thereof. An exemplary sugar-based biopolymer is bacterial cellulose.

As used in the present description, the term "amino-acid based biopolymer" encompasses linear and branched polypeptides, variants and derivatives thereof. An exemplary amino acid-based biopolymer is bacterial collagen.

According to various embodiments, the bacterial biopolymer is selected from bacterial cellulose, bacterial collagen, or mixtures thereof.

According to embodiments of the invention, the bacterial biopolymer layer comprises a bacterial biopolymer selected from bacterial cellulose, bacterial collagen, bacterial cellulose/chitin copolymer, bacterial silk, and mixtures thereof. These biopolymers are known per se in the art.

For example, a bacterial biopolymer according to the invention (e.g., the bacterial cellulose) can be produced by culturing bacterial biopolymer-producing microorganisms, such as selected from bacteria, algae, yeast and fungi and mixtures thereof.

As above mentioned, in the present description reference is made to "bacterial biopolymer" for sake of simplicity, without however limiting the scope of the invention to polymers produced by "bacteria" only, but encompassing all the polymers the can be produced by a "microorganism" as above defined, such as bacteria, yeast, fungi, viruses and algae.

According to embodiments of the invention, the bacterial biopolymer is produced by bacteria, and such bacterial biopolymer-producing bacteria are selected from *Gluconacetobacter, Aerobacter, Acetobacter, Achromobacter, Agrobacterium, Azotobacter, Salmonella, Alcaligenes, Pseudomonas, Rhizobium, Sarcina* and *Streptoccoccus* and *Bacillus* genus, and mixtures thereof.

According to embodiments of the invention, the bacterial biopolymer is produced by algae, and such bacterial biopolymer-producing algae are selected from Phaeophyta, Rhodophyta and Chrysophyta, and mixture thereof.

For example, bacterial cellulose can be produced by culturing strains of *Acetobacter* bacteria, such as strains of *Acetobacter xylinum*, and/or by culturing strains of *Gluconacetobacter*, such as strains of *Gluconacetobacter hansenii.*

For example, bacterial collagen can be produced by culturing bacterial strains of *Bacillus, Pseudomonas, Streptococcus* or bacterial strains which have been genetically modified to obtain modified strains that produce collagen.

Advantageously, bacterial collagen can be produced to provide an artificial leather-like material, ("artificial leather" or "artificial skin", wherein the main structural component of "leather" and "skin" is type I collagen in the form of strong fibrils).

For example, bacterial cellulose/chitin copolymer can be produced by culturing strains of *Acetobacter xylinum* which have been genetically modified to obtain modified strains that produce bacterial cellulose/chitin copolymer.

According to embodiments of the invention, the bacterial biopolymer producing microorganisms are a mixture of wild type and genetically modified microorganisms.

In various embodiments, the bacterial biopolymer producing microorganisms are a mixture of wild type and genetically modified bacteria.

As above discussed, the present invention refers to a composite fabric, comprising a base fabric and at least one bacterial biopolymer layer, wherein the base fabric is a woven fabric comprising warp yarns and weft yarns woven together, and having a front side and a back side. A first plurality of warp yarns and at least one plurality of first weft yarns form a base layer of the base fabric, and at least one second plurality of warp yarns and/or at least one plurality of second weft yarns forms an additional layer of the base fabric in the form of loop portions, on at least one of the sides of the base fabric. The at least one bacterial biopolymer layer is provided at least on part of the additional layer.

As used herein, the term "front side" of the fabric, refers to the side of the fabric which is the external visible side when a garment comprising the fabric is worn.

As used herein, the term "back side" of the fabric, refers to the side of the fabric which is the internal not visible side when a garment comprising the fabric is worn.

According to various embodiments, the composite fabric of the invention is a composite fabric comprising a base fabric and at least one bacterial biopolymer layer, wherein the base fabric is a woven fabric comprising warp yarns and weft yarns woven together, and having a front side and a back side, wherein the weft yarns comprise a plurality of first weft yarns and at least one plurality of second weft yarns, the warp yarns and the plurality of first weft yarns form a base layer of the base fabric, and the at least one plurality of second weft yarns forms an additional layer of the base fabric, in the form of loop portions, on at least one of the sides of the base fabric, wherein the at least one bacterial biopolymer layer is coupled with at least part of the additional layer.

According to an embodiment, the at least one plurality of second weft yarns, forms an additional layer of the base fabric, in the form of loop portions, at least along the front side of the base fabric.

In various embodiments, the at least one plurality of second weft yarns, forms an additional layer of loop portions of the base fabric, along the front side of the base fabric, by floating over three to twenty-four warp yarns, and in various embodiments by floating over five to twenty-four warp yarns and in some embodiments by floating over seven to twenty-four warp yarns.

According to an embodiment, the at least one plurality of second weft yarns, forms an additional layer of the base fabric, in the form of loop portions, at least along the back side of the base fabric.

In various embodiments, the at least one plurality of second weft yarns forms an additional layer of the base fabric in the form of loop portions along the back side of the base fabric by floating under three to twenty-four warp yarns, and in various embodiments by floating under five to twenty-four warp yarns and in some embodiments by floating under seven to twenty-four warp yarns.

According to various embodiments, a plurality of warp yarns and/or a plurality of weft yarns form an additional layer of the base fabric in the form of loop portions along both the front side and the back side of the fabric.

In this case, the base fabric is provided with, for example, at least two pluralities of weft yarns and, therefore, two additional layers (in the form of loop portions).

According to various embodiments, at least one plurality of second weft yarns forms an additional layer of the base fabric in the form of loop portions along both the front side and the back side of the base fabric.

For example, a first plurality of second weft yarns forms a first additional layer on the front side, and a second plurality of second weft yarns forms a second additional layer on the back side. In this case, the loop portions of the first additional layer can have the same or a different structure compared to the loop portions of the second additional layer. Additionally, the first plurality of second weft yarns can be the same or different with respect to the second plurality of second weft yarns.

According to embodiments, at least one plurality of weft yarns is made of a different material with respect to warp yarns.

When weft yarns comprise first weft yarns and second weft yarns, according to embodiments, at least a plurality of second weft yarns is made of a different material with respect to the first weft yarns and/or with respect to the warp yarns.

For example, a first plurality of second weft yarns can be made of the same material of a second plurality of second weft yarns, or it can be made of a different material. Additionally, the first plurality of second weft yarns can have the same linear density of the second plurality of second weft yarns, or it can have a different linear density.

Advantageously, when the base fabric is provided with two additional layer (in the form of loop portions), a first additional layer on the front side, and a second additional layer on the back side, a composite fabric comprising two bacterial biopolymer layers can be obtained.

Namely, at least one bacterial biopolymer layer can be coupled with at least part of the first additional layer (on the front side of the base fabric), and at least one bacterial biopolymer layer can be coupled with at least part of the second additional layer (on the back side of the base fabric).

In this case, the base fabric is between at least two bacterial biopolymer layers in the composite fabric of the invention.

According to embodiments, the at least two bacterial biopolymer layers can comprise the same or a different bacterial biopolymer; for example, a layer of bacterial collagen can be coupled with the first additional layer on the front side of the base fabric and a layer of bacterial cellulose can be coupled the second additional layer on the back side of the fabric.

In various embodiments, the at least one plurality of second weft yarns forms an additional layer of the base fabric in the form of loop portions along the front side of the base fabric by floating over up to twenty warp yarns, and in various embodiments by floating over up to fifteen warp yarns and in some embodiments by floating over up to a maximum of 12 warp yarns.

In various embodiments, the at least one plurality of second weft yarns forms an additional layer of the base fabric in the form of loop portions along the back side of the base fabric by floating under up to twenty warp yarns, and in various embodiments by floating under up to fifteen warp yarns and in some embodiments by floating under up to a maximum of 12 warp yarns.

According to various embodiments, the loop portions are on only one of the sides of the base fabric, preferably on the front side.

According to embodiments, the length of the loop portions formed by the second weft yarns is selected depending on the number of warp yarns to be passed, and/or in order to obtain over portions which can be more or less loosely woven to the base layer.

In other words, the length of the loop portions is selected in order or to obtain loop portions which hang loosely on the base layer such that they are droopy, thus obtaining an additional layer which is not tightly associated to the base layer.

According to various embodiments, the base fabric has at least two pluralities of second weft yarns.

According to embodiments of the invention, the base fabric has an average ratio "second weft yarns:first weft yarns" ranging from 1:1 to 2:1; in other words, for each first weft yarn in the fabric, there is an average number of second weft yarns ranging from 1 to 2.

According to an embodiment, the warp yarns, and/or the weft yarns (e.g. the first weft yarns, and/or the second weft yarns) of the base fabric have a linear density ranging from 118,2 tex (5/1 Ne) to 5,91 tex (100/1 Ne), a linear density ranging from 19,7 tex (30/1 Ne) to 8,44 tex (70/1 Ne); or a linear density ranging from 13,13 tex (45/1 Ne) to 10,754 tex (55/1 Ne), wherein "tex" is a known count unit used in textile field and refer to the mass per unit length of textile yarns and threads (1 tex=$10^{-6}$ kg·m$^{-1}$), and wherein "Ne" is the English cotton number that is a known count unit used in the textile field.

According to embodiments, the first weft yarns and the second weft yarns are different.

According to embodiments, the first weft yarns and the second weft yarns have different linear density.

In some embodiments, warp yarns are cotton yarns.

In embodiments of the invention, the second weft yarns are made by a different material with respect to the first weft yarns and/or the warp yarns.

In embodiments of the invention, the warp yarns and/or the weft yarns are selected from natural yarns, synthetic yarns and mixed yarns.

According to various embodiments, at least the warp yarns are natural yarns. In various embodiments, natural warp yarns comprise natural fibers selected from cotton, wool, flax, kenaf, ramie, hemp, linen and mixtures thereof.

In embodiments of the invention, the first weft yarns and the second weft yarns of the base fabric, are both natural yarns (for example, cotton yarns), i.e. yarns that are made of natural fibers (for example, cotton fibers).

In other embodiments of the invention, the first weft yarns of the base fabric are synthetic yarns. The first weft yarns may be thermoplastic yarns, in particular thermoplastic elastomeric yarns, and the second weft yarns are natural yarns.

In various embodiments, synthetic yarns comprise synthetic fibers selected from polyester, rayon, nylon, lycra and mixtures thereof.

In still other embodiments, the first weft yarns are natural yarns, and the second weft yarns are synthetic yarns such as thermoplastic yarns.

In various embodiments, natural weft yarns comprise natural fibers selected from cotton, wool, flax, kenaf, ramie, hemp, linen and mixtures thereof.

According to embodiments of the invention, the warp yarns and/or the weft yarns (namely, the first weft yarns and/or the second weft yarns) of the base fabric are mixed yarns, i.e. yarns comprising both natural fibers and synthetic fibers.

According to embodiments, synthetic yarns comprise fibers of elastane.

According to embodiments, the yarns comprise regenerated fibers; for example regenerated fibers can be selected from lyocell, modal, viscose, bamboo, and mixture thereof.

According to embodiments of the invention, natural fibers and yarns are hard fibers and yarns.

According to embodiments of the invention, synthetic fibers and yarns are elastomeric fibers and yarns.

Suitable elastomeric yarns are yarns containing elastomeric fibers. An "elastomeric fiber" is a fiber made of a continuous filament or a plurality of filaments which have an elongation at break of at least 100%, independent of any crimp. Break elongation may be measured e.g. according to ASTM D2256/D2256M-10(2015). An "elastomeric fiber" is a fiber that after being stretched to twice its length and held for one minute at the length, will retract to less than 1.5 times its original length within one minute of being released.

According to an aspect of the invention, any fabric having loops (i.e. loop portions), may be used as "base fabric" according to the present invention.

According to embodiments, the base fabric may be an inelastic fabric wherein the loops are formed during the weaving process.

According to embodiments, the base fabric may be a fabric wherein the loops (i.e. the loop portions) are obtained by heat shrinkage of some yarns.

In some embodiments the length of the loop portions increases when the fabric is wet.

According to exemplary embodiments, fabric structures suitable to be used as "base fabric" in according to the present invention are disclosed in patent application US2015/0038042 (see in particular paragraphs [0013], [0019]-[0027], [0030], [0031], [0033], [0049]-[0051], [0054], [0055], [0060], [0066], [0068]-[0071], [0075], [0076], [0078]-[0083], [0086], [0089]-[0117]) and in patent application US2013/0048140 (see in particular paragraphs [0007], [0010], [0013]-[0018], [0041]-[0046], [0048]-[0050], [0054]-[0059] and Examples 1, 3-8 and 10) whose descriptions are incorporated herein by reference.

According to various embodiments, the base fabric is a denim fabric. In some embodiments, the base fabric is an elastic denim fabric.

According to embodiments, the base fabric may be a uni-stretch fabric or a bi-stretch fabric.

In other words, the base fabric may be a fabric that can be stretched in warp direction or in weft direction, or both in warp and weft direction.

According to embodiments, the base fabric may be a multi-axis-stretchable fabric, i.e. a fabric that can be stretched in all directions.

According to embodiments, the base fabric is a denim fabric having a weight of 5 ounces/square yard or less; in other words, the denim fabric is a "very light" denim fabric. A "very light" denim fabric may comprise first weft yarns and/or second weft yarns having a linear density ranging from 32,833 tex (18/1 Ne) to 5,91 tex (100/1 Ne), a linear density ranging from 24,625 tex (24/1 Ne) to 5,91 tex (100/1 Ne), or a linear density ranging from 24,625 tex (24/1 Ne) to 11,82 tex (50/1 Ne).

According to embodiments, the base fabric is a denim fabric having a weight ranging from 5 ounces/square yard to 8 ounces/square yard; in other words, the denim fabric is a "medium light" denim fabric. In various embodiments, a "medium light" denim fabric comprises first weft yarns and/or second weft yarns having a linear density ranging from (49,25 tex 12/1 Ne) to 14,775 tex (40/1 Ne).

According to embodiments, the base fabric is a denim fabric having a weight ranging from 8 ounces/square yard to 12.5 ounces/square yard; in other words, the denim fabric is a "normal" denim fabric. In various embodiments, a "normal" denim fabric comprises first weft yarns and/or second weft yarns having a linear density ranging from 84,43 tex (7/1 Ne) to 5,91 tex (100/1 Ne), or from 73,875 tex (8/1 Ne) to 19,7 tex (30/1 Ne) in some embodiments. According to embodiments, the base fabric is a denim fabric having a weight over 12.5 ounces/square yard; in other words, the denim fabric is a "heavy" denim fabric. In various embodiments, a "heavy" denim fabric comprises first weft yarns and/or second weft yarns having a linear density ranging from 118,2 tex (5/1 Ne) to 24,625 tex (24/1 Ne).

Another object of the present invention is a process for producing a composite fabric comprising a base fabric and at least one bacterial biopolymer layer, comprising the following steps:

a. Providing a base fabric, wherein the base fabric is a woven fabric comprising warp yarns and weft yarns woven together, and having a front side and a back side, wherein a first plurality of warp yarns and at least one plurality of first weft yarns form a base layer of the base fabric, and at least one second plurality of warp yarns and/or at least one plurality of second weft yarns form an additional layer of the base fabric in the form of loop portions on at least one of the sides of the base fabric;
b. contacting at least part of at least one of the sides of the base fabric with a culture of bacterial biopolymer-producing microorganisms, the at least one of the sides being provided with the additional layer of loop portions;
c. culturing the bacterial biopolymer-producing microorganisms, to provide the base fabric with at least one bacterial biopolymer layer produced by the bacterial biopolymer-producing microorganisms.

According to various embodiments, the base fabric provided in step a. is a woven fabric wherein the weft yarns comprise a plurality of first weft yarns and at least one plurality of second weft yarns, the warp yarns and the plurality of first weft yarns form a base layer of the base fabric, and the at least one plurality of second weft yarns forms an additional layer of loop portions of the base fabric on at least one of the sides of the base fabric.

According to an aspect, the process of the invention provides a composite fabric, comprising a base fabric and at least one bacterial biopolymer layer, wherein the bacterial biopolymer layer is produced (i.e. "cultured", i.e. "grown") directly on the base fabric.

Advantageously, the loop portions of the base fabric allow the bacterial biopolymer-producing microorganisms to reach and contact the base layer, by passing through the additional layer. In various embodiments, bacterial biopolymer-producing microorganisms do not penetrate deeply into the body of the base layer of the base fabric, but they substantially settle on the base layer (i.e. on the surface of the base layer), and grow through the additional layer of the base fabric. More in detail, once the base fabric is contacted with a culture of bacterial biopolymer-producing microorganisms, bacterial biopolymer-producing microorganisms are cultured, allowing them to produce a layer of bacterial biopolymer directly on the base fabric, through its additional layer, thus providing a composite fabric.

According to an aspect, the process of the invention provides a composite fabric wherein the loop portions (which form the additional layer of the base fabric) extent into the bacterial biopolymer layer; in other words, the bacterial biopolymer layer grows through the additional layer, namely between and surrounding the loop portions, which thus result "immersed" into the layer of bacterial polymer of the obtained composite fabric, once the bacterial biopolymer layer is grown. The layer of bacterial polymer is thus "anchored" (i.e. "attached" or "secured") to the base fabric through the loop portions, which act as "securing means" to maintain the biopolymer layer attached to the side of the base fabric.

Advantageously, as above mentioned, the loop portions forming the additional layer of the base fabric have a dual function: the first function is to allow the microorganisms to reach the base layer (namely the surface of the base layer) of the base fabric when the base fabric is contacted with a culture of bacterial biopolymer-producing microorganisms; the second function of the loop portions is to act as physical binders (i.e. "securing means") between the bacterial biopolymer layer and the base fabric, thus allowing the bacterial biopolymer layer to be coupled (namely, "attached" or "secured") to the base fabric, without the use of chemical binders and/or cross-linkers. As above discussed, without being bound to a specific scientific explanation, it has been hypothesized that, since chemical binders and/or cross-linkers are not necessary to couple bacterial biopolymer layer to the base fabric, the chemical —OH groups of the bacterial biopolymer layer and the chemical —OH groups of the fabric, are "free" and "available" to react with the dye, thus providing a composite fabric which can be easy and effectively dyed, with a reduction of the amount of the dye employed and, therefore a reduction in the manufacturing costs.

In various embodiments, the bacterial biopolymer layer is produced by bacterial biopolymer-producing microorganisms which are selected from bacteria, algae, yeast, fungi and mixtures thereof, namely bacterial biopolymer-producing bacteria, bacterial biopolymer-producing algae, bacterial biopolymer-producing fungi, and mixtures thereof.

According to embodiments of the invention, the bacterial biopolymer producing microorganisms are wild type microorganisms.

According to embodiments of the invention, the bacterial biopolymer producing microorganisms are genetically modified microorganism, i.e. microorganisms that are genetically modified in order to produce a bacterial biopolymer which is not produced by the wild type microorganisms.

According to embodiments of the invention, the bacterial biopolymer producing microorganisms are a mixture of wild type and genetically modified microorganisms.

In various embodiments, the bacterial biopolymer-producing microorganisms are bacteria or algae.

According to embodiments of the invention, bacterial biopolymer-producing bacteria are selected from *Gluconacetobacter, Aerobacter, Acetobacter, Achromobacter, Agrobacterium, Azotobacter, Salmonella, Alcaligenes, Pseudomonas; Rhizobium, Sarcina, Streptoccoccus* and *Bacillus* genus, and mixtures thereof.

According to embodiments of the invention, bacterial biopolymer-producing algae are selected from Phaeophyta, Rhodophyta and Chrysophyta, and mixture thereof.

According to various embodiments, the bacterial biopolymer is a sugar-based biopolymer such as bacterial cellulose, or an amino acid-based biopolymer such as bacterial collagen, or a mixture thereof.

According to various embodiments, the bacterial biopolymer is a sugar-based bacterial biopolymer, and may be is bacterial cellulose.

According to various embodiments, the bacterial biopolymer is an amino acid-based bacterial biopolymer, and may be is bacterial collagen.

According to an aspect of the invention, the culturing condition of the bacterial biopolymer-producing microorganisms are selected in view of the selected microorganisms, i.e., in order to provide the selected microorganisms with optimal growing conditions.

According to an aspect of the invention, the bacterial biopolymer producing microorganisms and the culturing condition can be selected in order to obtain the desired thickness of the bacterial biopolymer layer.

For example, a base fabric according to the invention can be contacted with a culture of bacterial-biopolymer producing microorganisms, for example bacteria, having a concentration ranging from $1\times10^3$ cells/ml to $1\times10^5$ cells/ml, a concentration ranging from $5\times10^3$ cells/ml to $8\times10^4$ cells/ml, or a concentration ranging from of $1\times10^4$ cells/ml to $2\times10^4$ cells/ml, where the concentration of the culture is determined with the spread plate method, which is a known technique in the field of microbiology.

For example, a culture of bacterial-biopolymer producing microorganisms can be either sprayed on at least one side of the base fabric (e.g. the front side, if the additional layer is on the front side of the base fabric) or the culture can be pipetted on the base fabric.

According to some embodiments, 1 $m^2$ of a base fabric according to the invention can be contacted with 400 ml. According to some embodiments, 1 $m^2$ of a base fabric according to the invention can be contacted 450 ml, or preferably 500 ml of a culture of bacterial-biopolymer producing microorganisms, having a concentration of $2\times10^4$ cells/ml, to obtain a bacterial biopolymer layer.

In various embodiments, the process of the invention further comprises a step d. of washing the composite fabric, obtained in step c., in order to remove the bacterial biopolymer-producing microorganisms.

In various embodiments, the process of the invention further comprises a step e. of dyeing the composite fabric.

According to embodiments of the invention, step e. of dyeing the composite fabric is carried out by impregnating the composite fabric with the dye, or by spraying or printing the dye on one or both of the sides of the composite fabric.

In various embodiments, the dye is the indigo dye.

Advantageously, according to an aspect of the invention, when the bacterial biopolymer layer is coupled to the additional layer of the base fabric only on one side, preferably the front side, of the base fabric, the dye is applied on the side of the composite fabric wherein the bacterial biopolymer is placed.

An object of the invention is a composite fabric as obtainable by the process of the invention.

Another object of the invention is a clothing article that comprises a composite fabric according to the invention, i.e. a composite fabric which comprises a base fabric and at least one bacterial biopolymer layer according to the invention.

According to various embodiments of the clothing article of the invention, the at least one bacterial biopolymer layer is coupled with at least part of the additional layer of the base fabric, wherein the additional layer is on the front side and/or the back side of the base fabric, and wherein the front side is the external visible side when the clothing article is worn, and the back side is the internal not visible side when the clothing article is worn.

According to embodiments, the base fabric is tailored into a clothing article, i.e. a garment, and the bacterial biopolymer layer is provided to the base fabric after the tailoring into a garment. In other words, a bacterial biopolymer layer can be provided to a garment comprising a base fabric according to the invention, e.g. in correspondence of the portions of the garment that are made of the base fabric according to the invention.

BRIEF DESCRIPTION OF THE DRAWINGS

Further aspects and advantages of the present invention will be discussed more in detail with reference to the enclosed drawings, illustrating embodiments of the invention and that are provided by way of non-limiting example, wherein.

DETAILED DESCRIPTION OF EMBODIMENTS OF THE INVENTION

Figure 1:
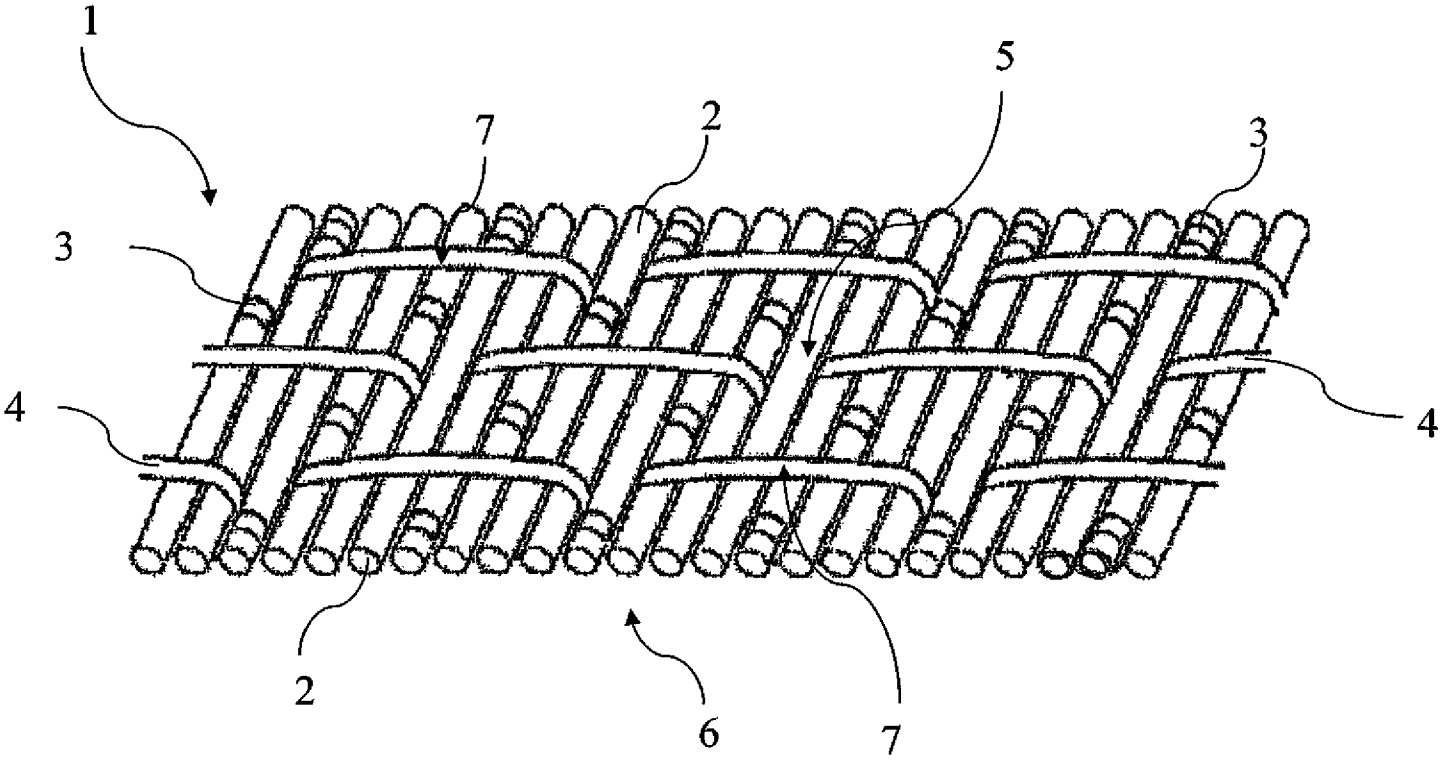
FIG. 1 is a perspective view of an embodiment of the base fabric according to the invention.

FIG. 1 is a schematic perspective view of a portion of an exemplary embodiment of the base fabric according to the invention.

FIG. 1 shows a portion of an exemplary base fabric 1, which comprises a plurality of warp yarns 2, a plurality of first weft yarns 3 and a plurality of second weft yarns 4. Warp yarns 2, first weft yarns 3, and second weft yarns 4, are woven together in a pattern, to form a base layer 1*a* of the base fabric 1. The base fabric 1 has a front side 5 and a back side 6.

According to an aspect, first weft yarns 3 of base fabric 1 are woven together with the warp yarns 2 to from a base layer 1*a* of the base fabric 1, and second weft yarns 4 form an additional layer 1*b* of the base fabric 1.

In particular, in the embodiment of FIG. 1 second weft yarns 4 form an additional layer 1*b* of the base fabric 1 in the form of loop portions 7, on the front side 5 of the base fabric 1.

Figure 3:
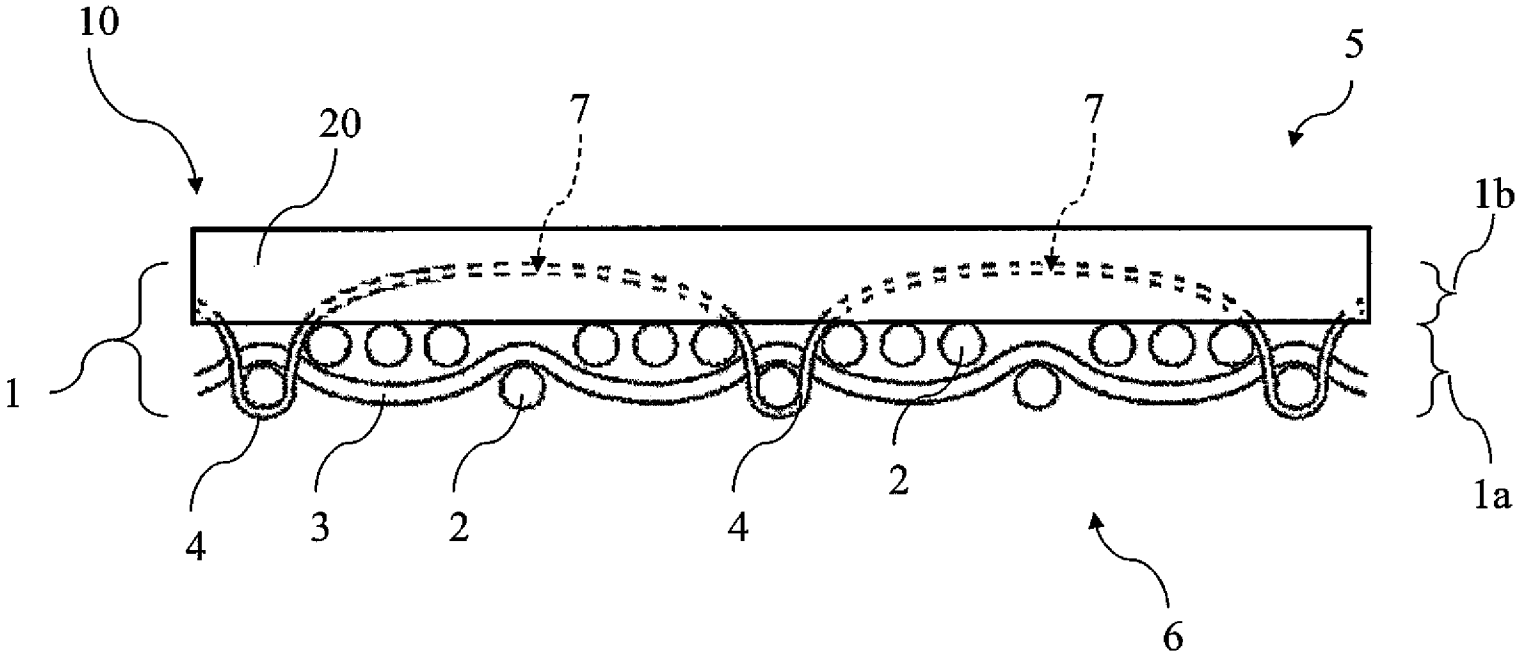
FIG. 3 is a cross-sectional view of a portion of a composite fabric according to the invention.

The base layer 1*a* and the additional layer 1*b*, which are not indicated in FIG. 1, are illustrated e.g. in FIG. 3.

In the exemplary embodiment shown in FIG. 1, second weft yarns 4 form loop portions 7 when they pass over the warp yarns 2, on the front side 5 of the base fabric 1.

In the embodiment shown in FIG. 1, second weft yarns 4 form loop portions 7 by floating over seven warp yarns 2.

In the embodiment of the base fabric 1 shown in FIG. 1, warp yarns 2 and weft yarns 3,4 are not dyed.

Figure 2:
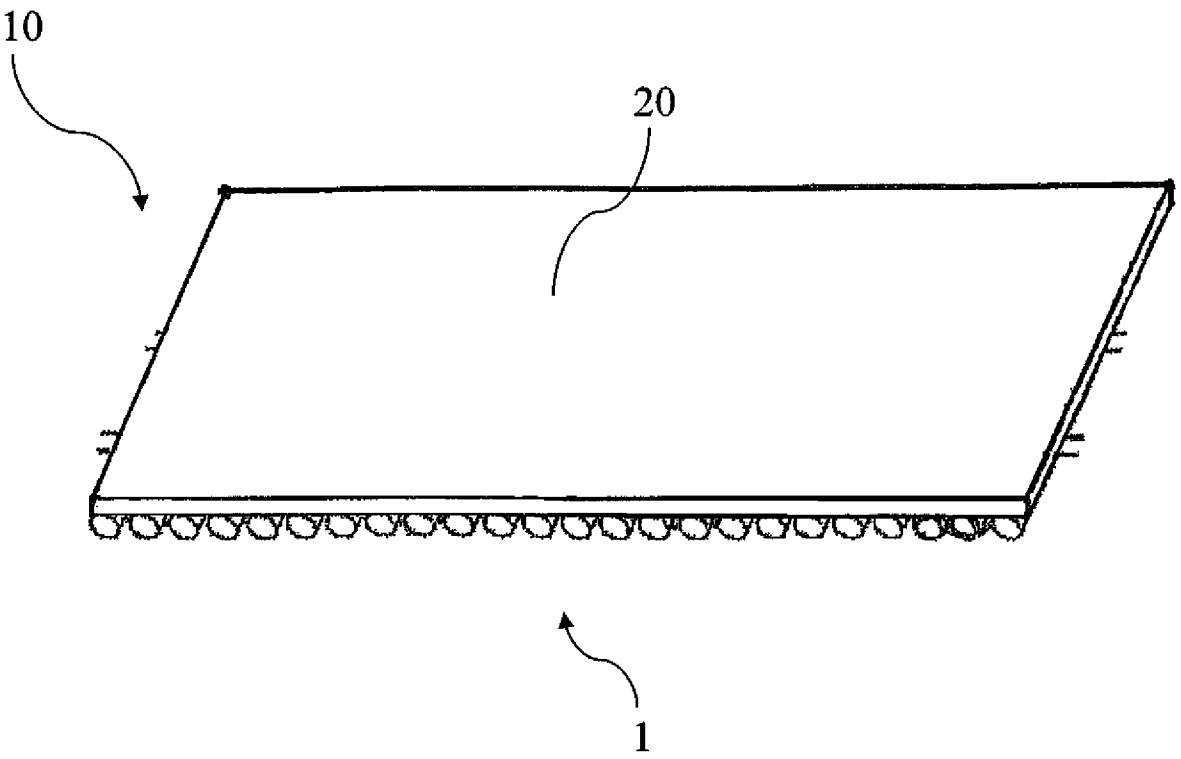
FIG. 2 is a perspective view of an embodiment of the composite fabric of the invention.

FIG. 2 shows a schematic perspective view of a composite fabric 10 according to the invention. FIG. 2 shows a base fabric 1 coupled with a bacterial biopolymer layer 20.

For example, the base fabric 1 of FIG. 2 can be the same base fabric 1 illustrated in FIG. 1. In this case, the bacterial biopolymer layer 20 is provided on the base fabric 1 on its front side 5. In particular, the bacterial biopolymer layer 20 is coupled with the additional layer 1*b* of loop portions 7; in other words, the base fabric 1 is coupled with the layer of bacterial biopolymer 20 through the additional layer 1*b*, i.e., through the loop portions 7. The loop portions 7 act as "securing means" to maintain the bacterial biopolymer layer 20 attached to the front side 5 of the base fabric 1.

FIG. 3 is a schematic cross-sectional view of a portion of a composite fabric 10 according to the invention, comprising a base fabric 1 and a bacterial biopolymer layer 20.

FIG. 3 shows a base fabric 1, having warp yarns 2 and weft yarns 3,4 woven together, having a front side 5 and a back side 6.

First weft yarns 3 of base fabric 1 are woven together with the warp yarns 2 to form a base layer 1*a* of the base fabric 1; the second weft yarns 4 form an additional layer 1*b* of the base fabric 1.

In particular, second weft yarns 4 form an additional layer 1*b* of the base fabric 1 in the form of loop portions 7, on the front side 5 of the base fabric 1. FIG. 3 shows an embodiment of the composite fabric 10 of the invention wherein the bacterial biopolymer layer 20 is coupled with the base fabric 1 by means of the additional layer 1*b* of the base fabric 1. Loop portions 7, which form the additional layer 1*b* of the base fabric 1, are, as shown in FIG. 3, "immersed" into the bacterial biopolymer layer 20. The bacterial biopolymer layer 20 is thus "anchored" (i.e. "attached" or "secured") to the base fabric 1 through the loop portions 7.

Embodiments of the composite fabric 10 of the invention, where the loop portions 7 of the base fabric 1 are "immersed" into the bacterial biopolymer layer 20, can be advantageously obtained by growing (i.e. "producing") the bacterial polymer directly on the base fabric 1.

For example, the composite fabric 10 illustrated in FIG. 3, can be obtained by contacting the front side 5 (i.e., the same side of the base fabric 1 where second weft yarns 4 form the additional layer 1*b* in the form of loop portions 7) of the base fabric 1, with a culture of bacterial biopolymer-producing microorganisms, e.g. bacterial biopolymer-producing bacteria, and culturing the bacterial biopolymer-producing microorganisms. The loop portions 7 allow the bacterial biopolymer-producing microorganisms to pass through the additional layer 1*b* on the front side 5 of the base fabric 1, reaching and contacting the surface of the base layer 1*a* on the front side 5 of the base fabric 1. In various embodiments, bacterial biopolymer-producing microorganisms do not penetrate deeply into the base layer 1*a*, but they substantially settle on the surface of the base layer 1*a* on the front side 5 of the base fabric 1. Bacterial biopolymer-producing microorganisms are then cultured, allowing them to produce a layer of bacterial biopolymer 20 (i.e. a bacterial biopolymer layer 20) which can have a thickness that is, for example, smaller, equal or greater than the thickness of the additional layer 1*b*. For example, a bacterial biopolymer layer 20, e.g. a layer of bacterial cellulose, according to the invention, is grown on the fabric, in about 10 to 23 hours, e.g. 14-18 hours.

In the embodiment of FIG. 3, the bacterial biopolymer layer 20 has a thickness that is greater than the thickness of the additional layer 1*b*.

For example, a garment comprising the composite fabric 10 of FIG. 3, has the bacterial biopolymer layer 20, which is on the front side 5 of the base fabric 1, that is visible when the garment is worn; i.e., the bacterial biopolymer layer 20 is on the external visible side of the garment. The back side 6 of the base fabric 1, on the contrary, is on the internal side of the garment and is not visible when the garment is worn.

Figure 4:
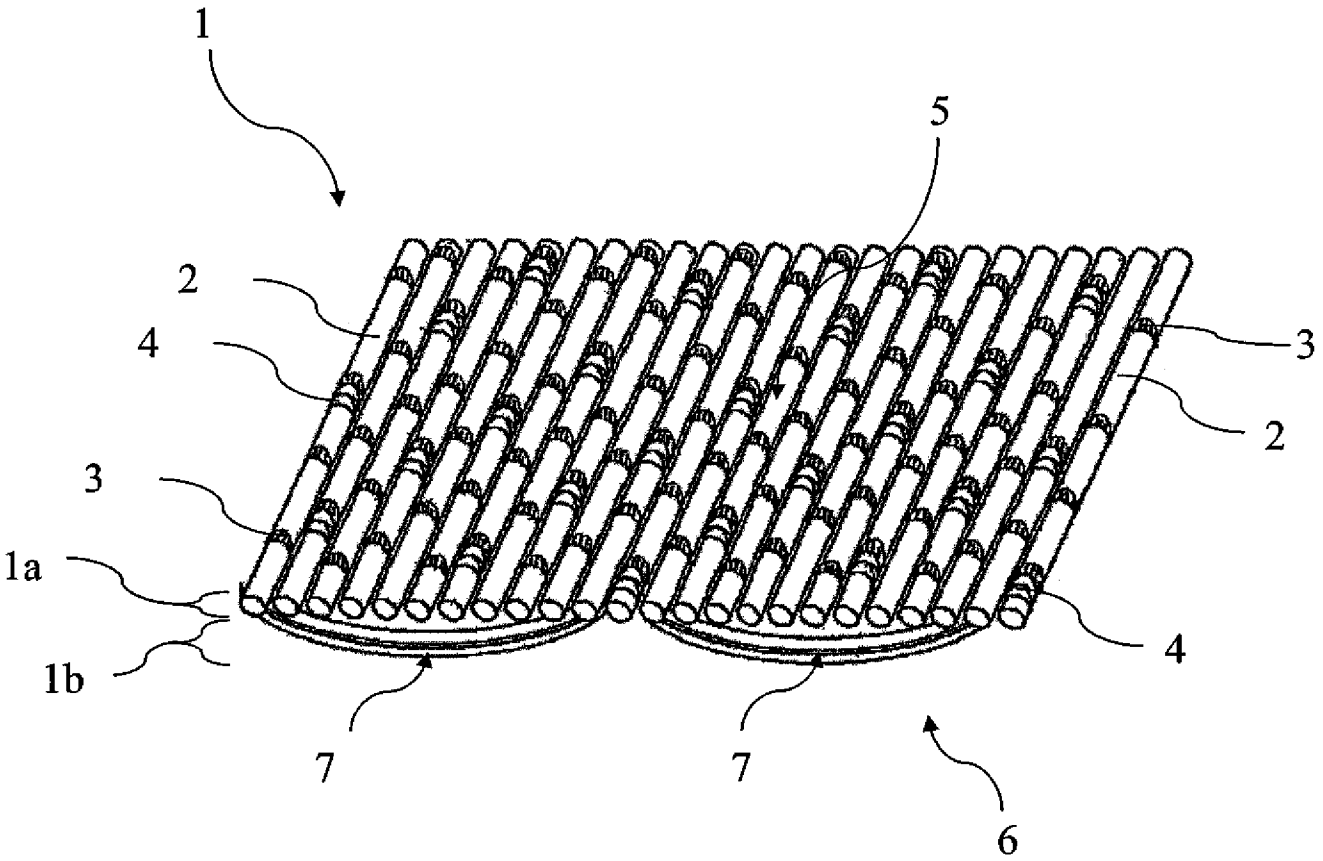
FIG. 4 is a perspective view of another embodiment of the base fabric according to the invention.

FIG. 4 is a schematic perspective view of an exemplary embodiment of the base fabric 1 according to the invention.

FIG. 4 shows a base fabric 1, having a front side 5 and a back side 6.

Base fabric 1 of FIG. 4 comprises warp yarns 2, first weft yarns 3 and second weft yarns 4. Warp yarns 2 and first weft yarns 3 form the base layer 1*a* of the base fabric 1.

The second weft yarns 4 form loop portions 7, by floating under a determined number of warp yarns 2. Loop portions 7 form the additional layer 1*b* on the back side 6 of the base fabric 1.

In the exemplary embodiment of FIG. 4, the second weft yarns 4 form loop portions 7 by floating under eleven warp yarns 2.

FIG. 4 shows a base fabric 1 which comprises two pluralities of second weft yarns 4, form the additional layer 1*b* on the back side 6 of the base fabric 1 in the form of loop portions 7.

Figure 5:
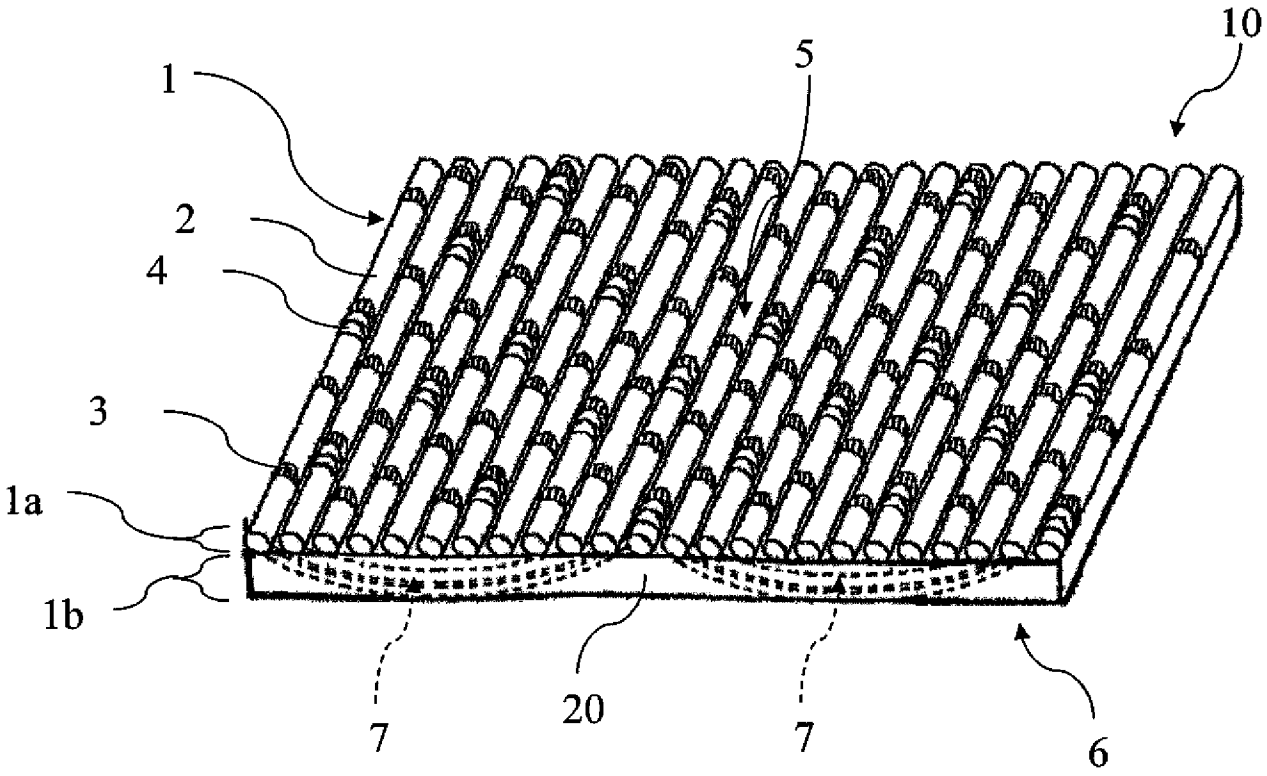
FIG. 5 is a perspective view of another embodiment of the composite fabric of the invention.

FIG. 5 shows a schematic perspective view of a composite fabric 10 according to the invention. FIG. 5 shows a base fabric 1 coupled with a bacterial biopolymer layer 20.

The base fabric 1 of the exemplary embodiment of the composite fabric 10 according to the invention represented in FIG. 5 can be, e.g., the same base fabric 1 illustrated in FIG. 4.

Base fabric 1 of FIG. 5 comprises warp yarns 2, first weft yarns 3 and second weft yarns 4, and has a front side 5 and a back side 6. Warp yarns 2 and first weft yarns 3 form the base layer 1*a* of the base fabric 1.

The second weft yarns 4 form the additional layer 1*b*, in the form of loop portions 7, on the back side 6 of the base fabric 1.

The bacterial biopolymer layer 20 is provided to the base fabric 1 on the back side 6 of the base fabric 1. In other words, the layer of bacterial biopolymer 20 is coupled with the additional layer 1*b* of the base fabric 1, i.e. is coupled with the loop portions 7 on the back side 6 of the base fabric 1. FIG. 5 shows an embodiment of the composite fabric 10 of the invention wherein the base fabric 1 is coupled, through its additional layer 1*b*, i.e., through the loop portions 7, with a bacterial biopolymer layer 20, on its back side 6. The loop portions 7 act as "securing means" to maintain the bacterial biopolymer layer 20 attached to the back side 6 of the base fabric 1.

FIG. 5 schematically represents an embodiment of the composite fabric 10 of the invention wherein the bacterial biopolymer layer 20 has a thickness that is equal to the thickness of the additional layer 1*b*.

Figure 6:
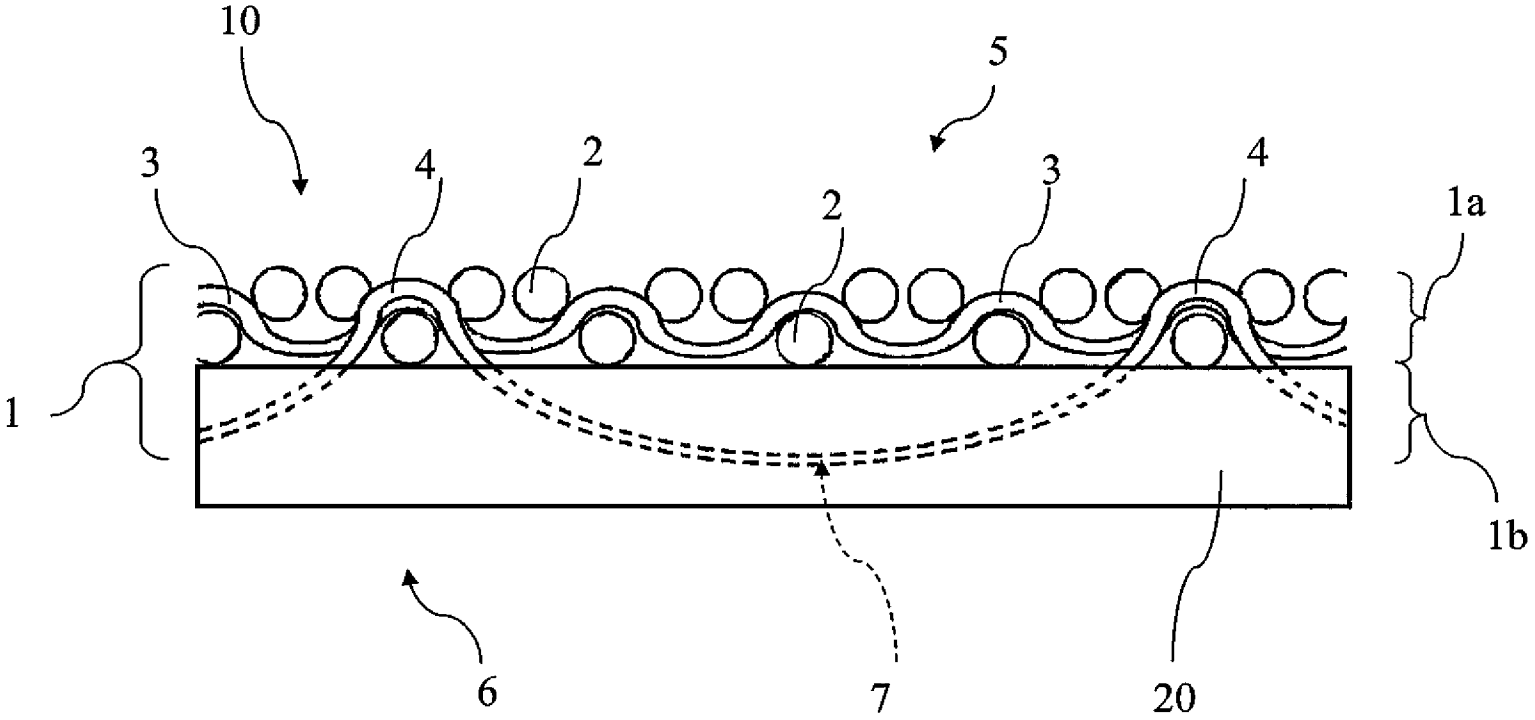
FIG. 6 is a cross-sectional view of a portion of an embodiment of the composite fabric of the invention.

FIG. 6 is a schematic cross-sectional view of a portion of an exemplary composite fabric 10 according to the invention.

FIG. 6 shows a base fabric 1, having warp yarns 2 and weft yarns 3,4 woven together, and a front side 5 and a back side 6.

First weft yarns 3 of base fabric 1 are woven together with the warp yarns 2 to from a base layer 1*a* of the base fabric 1; the second weft yarns 4 form an additional layer 1*b* of the base fabric 1.

More in detail, second weft yarns 4 form an additional layer 1*b* of the base fabric 1 in the form of loop portions 7, on the back side 6 of the base fabric 1.

FIG. 6 shows an embodiment of the composite fabric 10 of the invention wherein the bacterial biopolymer layer 20 is coupled with the additional layer 1*b* of the base fabric 1; i.e., in other words, the base fabric 1 is coupled, through its loop portions 7, with the bacterial biopolymer layer 20, the loop portions 7 forming the additional layer 1*b* of the base fabric 1, on the back side 6 of the base fabric 1.

For example, a garment comprising the composite fabric 10 of FIG. 6, has the bacterial biopolymer layer 20, which is on the back side 6 of the base fabric 1, that is not visible when the garment is worn. The front side 5 of the base fabric 1, on the contrary, is on the external side of the garment and is visible when the garment is worn.

Similarly to the embodiment of the composite fabric of the invention illustrated in FIG. 3, the composite fabric 10 of FIG. 6 has loop portions 7 (which form the additional layer 1*b* of the base fabric 1 on the back side 6 of the base fabric 1) that extent into the bacterial biopolymer layer 20. In other words, loop portions 7 are "immersed" into the bacterial biopolymer layer 20. The bacterial biopolymer layer 20 is thus "anchored" (i.e. "attached" or "secured") to the base fabric 1, on its back side 6, through the loop portions 7.

Embodiments of the composite fabric 10 as shown in FIG. 6 can be advantageously obtained by growing (namely "producing") the bacterial biopolymer layer 20 directly on the base fabric 1. For example, a bacterial biopolymer layer 20 can be produced on a base fabric 1 by contacting the back side 6 (i.e., the same side of the base fabric 1 where the second weft yarns 4 form the additional layer 1*b* in the form of loop portions 7) of the base fabric 1, with a culture of bacterial biopolymer-producing microorganisms, and culturing the bacterial biopolymer-producing microorganisms directly on the base fabric 1.

EXAMPLES

The following examples will better illustrate an exemplary process for the production of a composite fabric according to the invention.

The following examples are to be interpreted as merely illustrative and they do not limit the scope of the invention.

Example 1

A sample base fabric according to the invention is provided.

Figure 7:
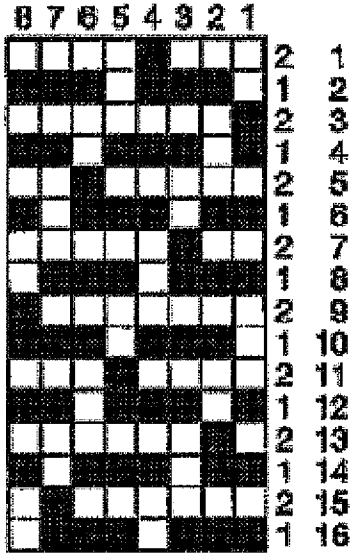
FIG. 7 shows a weaving report of an embodiment of a base fabric according to the invention.

The fabric has a plurality of warp yarns, a plurality of first weft yarns and a plurality of second weft yarns, according to the weaving report illustrated in FIG. 7.

Warp yarns are 73,875 tex (Ne 8/1), Ring slub cotton

First weft yarns ("1") are 84,43 tex (Ne 7/1), Ring cotton

Second weft yarns ("2") are 11,82 tex (Ne 50/1) Combed cotton

Warp density of the fabric is 29.5 threads/cm

Weft density of the fabric is 42.0 picks/cm

Warp yarns and first weft yarns form the base layer of the base fabric.

The second weft yarns form an additional layer, in the form loop portions that float over 7 warp yarns, on the front side of the base fabric.

The ratio first weft yarns to second weft yarns is 1:1.

Example 2

0.06 $m^2$ of the base fabric of Example 1 is contacted on its front side, where the second weft yarns form the additional layer, with 25 ml a culture of *Gluconacetobacter hansenii* having a concentration of $2\times10^4$ cells/ml.

The culture used is a culture of *Gluconacetobacter hansenii*, in Hestrin-Schramm (HS) medium containing 2% (w/v) glucose, 0.5% (w/v) peptone, 0.5% (w/v) yeast extract, 0.27% (w/v) $Na_2HPO_4$ and 1.15 g/L citric acid, and it is applied on the front side of the base fabric, i.e. on the same side on which the loop portions are present. For example, the culture of bacterial-biopolymer producing microorganisms (in this case, bacteria) can be applied by spraying it on the base fabric, or it can be pipetted on the base fabric.

Example 3

After the application of the bacterial culture of Example 2 on the base fabric, the base fabric is incubated for 16 hours, at temperature 28° C.

After 16 hours, at temperature 28° C., a layer of bacterial cellulose is obtained on the front side of the fabric, i.e. a composite fabric is obtained.

Example 4

The composite fabric obtained in Example 3 is washed with 0.1M NaOH at 80° C. temperature, for 20 minutes, to remove the residual bacteria from the composite fabric.

Example 5

The washed composite fabric is dyed, by impregnating the composite fabric with a solution of indigo dye.

The fabric including a dyed biopolymer layer, particularly a bacterial cellulose indigo dyed biopolymer layer, may undergo finishing processes as disclosed in co-pending application having title "A process of preparing a dyed fabric including a bacterial biopolymer and having unique appearance" in the name of the present applicant. The finishing processes may impart the dyed fabric with a "multi-shaded" appearance and/or "vintage" or worn-out look.

Although the invention has been described in terms of various embodiments, it is not limited thereto. Rather, the appended claims should be construed broadly, to include other variants and embodiments of the disclosure, which may be made by those skilled in the art without departing from the scope and range of equivalents of the invention.

The invention claimed is:

1. A composite fabric comprising a base fabric and at least one biopolymer layer, said base fabric being a woven fabric comprising warp yarns and weft yarns woven together, said base fabric having a front side and a back side, at least a first plurality of said warp yarns and a first plurality of said weft yarns forming a base layer of said base fabric, and at least a second plurality of said weft yarns forming an additional layer of loop portions on one of said sides of said base fabric, said at least one biopolymer layer being obtained from microorganisms and being disposed on at least part of said additional layer, wherein said biopolymer layer is produced directly on said fabric, whereby said loop portions extend into said biopolymer layer, and wherein said biopolymer is selected from the group consisting of bacterial cellulose, bacterial collagen, bacterial cellulose/chitin copolymer, bacterial silk, and mixtures thereof, wherein the composite fabric comprising said at least one biopolymer layer is dyed.

2. The composite fabric according claim 1, wherein at least one of said warp yarns and said weft yarns are hydrophilic yarns.

3. The composite fabric according to claim 1, wherein said warp yarns and said first plurality of said weft yarns form said base layer of said base fabric and said second plurality of said weft yarns forms said additional layer of loop portions along said front side of said base fabric, said second plurality of weft yarns floating over three to twenty-four of said warp yarns of said base layer.

4. The composite fabric according to claim 3, wherein said second plurality of said weft yarns of said additional layer of loop portions float over at least seven said warp yarns.

5. The composite fabric according to claim 1, wherein said warp yarns and said first plurality of said weft yarns form said base layer of said base fabric and said second plurality of said weft yarns forms said additional layer of loop portions, said additional layer of loop portions disposed along said back side of said base fabric by floating under three to twenty-four of said warp yarns.

6. The composite fabric according to claim 5, wherein said second plurality of said weft yarns of said additional layer of loop portions float under at least seven said warp yarns.

7. The composite fabric according to claim 1, wherein said weft yarns are made of a different material than said warp yarns.

8. The composite fabric according to claim 1, wherein at least one of said warp yarns and said weft yarns comprise natural yarns, synthetic yarns or mixed yarns.

9. The composite fabric according to claim 1, wherein said base fabric is a denim fabric.

10. The composite fabric according to claim 9, wherein said denim fabric is an elastic denim fabric.

11. A clothing article comprising the composite fabric according to claim 1.

12. The clothing article according to claim 1, wherein said front side of said base fabric is an external, visible side of said clothing article when the clothing article is worn, said back side is an opposed internal side not visible when the clothing article is worn and wherein said at least one biopolymer layer and said additional layer of loop portions are disposed on said front side.

13. The clothing article according to claim 11, wherein said front side of said base fabric is an external, visible side of said clothing article when the clothing article is worn, said back side is an opposed internal side not visible when the clothing article is worn and wherein said at least one biopolymer layer and said additional layer of loop portions are disposed on said back side.

* * * * *